US009207563B2

(12) United States Patent
Fujioka

(10) Patent No.: US 9,207,563 B2
(45) Date of Patent: Dec. 8, 2015

(54) IMAGE FORMING APPARATUS

(71) Applicant: CANON KABUSHIKI KAISHA, Tokyo (JP)

(72) Inventor: Ryota Fujioka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/415,319

(22) PCT Filed: Jul. 11, 2013

(86) PCT No.: PCT/JP2013/068982
§ 371 (c)(1),
(2) Date: Jan. 16, 2015

(87) PCT Pub. No.: WO2014/013932
PCT Pub. Date: Jan. 23, 2014

(65) Prior Publication Data

US 2015/0192877 A1 Jul. 9, 2015

(30) Foreign Application Priority Data

Jul. 18, 2012 (JP) ..... 2012-159517

(51) Int. Cl.

| | |
|---|---|
| ***G03G 15/01*** | (2006.01) |
| ***G03G 15/06*** | (2006.01) |
| ***G03G 15/16*** | (2006.01) |
| ***G03G 15/00*** | (2006.01) |
| ***G03G 21/00*** | (2006.01) |

(52) U.S. Cl.
CPC ..... *G03G 15/065* (2013.01); *G03G 15/0189* (2013.01); *G03G 15/1615* (2013.01); *G03G 15/50* (2013.01); *G03G 21/0005* (2013.01)

(58) Field of Classification Search
CPC ..... G03G 15/065; G03G 21/0005; G03G 21/0011
See application file for complete search history.

(56) References Cited

U.S. PATENT DOCUMENTS

| | | | |
|---|---|---|---|
| 2002/0037189 | A1 | 3/2002 | Kosuge |
| 2003/0063928 | A1 | 4/2003 | Matsuguma |

(Continued)

FOREIGN PATENT DOCUMENTS

| | | | |
|---|---|---|---|
| JP | 2000-039819 | A | 2/2000 |
| JP | 2003-005608 | A | 1/2003 |
| JP | 2003-076103 | A | 3/2003 |

(Continued)

*Primary Examiner* — Sandra Brase
(74) *Attorney, Agent, or Firm* — Canon USA, Inc. IP Division

(57) ABSTRACT

To provide an image forming apparatus that includes a plurality of image forming units and executes a mode for image formation by using a selected image forming unit, the image forming apparatus being able to restrict a decrease in productivity and restrict an image defect such as a lack of part of an image output during the execution of the mode.

In a monochrome mode for forming an image only with a black toner, in the first image forming unit, a toner is caused to adhere to a region on a photosensitive body corresponding to a sheet interval and hence the toner is supplied to a cleaning blade by applying a development bias to a developing unit without applying a direct-current voltage to a charger of a color image forming unit not used for the image formation. Also, an alternating-current voltage is applied to the charger when the region on the photosensitive body from which the toner is removed by the cleaning blade passes through the charger.

6 Claims, 10 Drawing Sheets

(56) References Cited

U.S. PATENT DOCUMENTS

2011/0150512 A1* 6/2011 Tamagaki ..... 399/53
2011/0150547 A1* 6/2011 Hirata ..... 399/350

FOREIGN PATENT DOCUMENTS

JP 2004-170605 A 6/2004
JP 2008-185919 A 8/2008

* cited by examiner

FIG. 7

| TEMPERATURE [°C] | NON-DISCHARGE REGION AC1' | NON-DISCHARGE REGION AC2' | NON-DISCHARGE REGION AC3' |
|---|---|---|---|
| 5.0 | 600 | 800 | 1000 |
| 10.0 | 600 | 800 | 1000 |
| 15.0 | 600 | 800 | 1000 |
| 20.0 | 600 | 800 | 1000 |
| 25.0 | 600 | 800 | 1000 |
| 30.0 | 600 | 800 | 1000 |
| 35.0 | 600 | 800 | 1000 |
| 40.0 | 600 | 800 | 1000 |

FIG. 8

| TEMPERATURE [°C] | DISCHARGE REGION AC1 | DISCHARGE REGION AC2 | DISCHARGE REGION AC3 |
|---|---|---|---|
| 5.0 | 2000 | 2300 | 2600 |
| 10.0 | 1800 | 2025 | 2300 |
| 15.0 | 1600 | 1750 | 2000 |
| 20.0 | 1400 | 1475 | 1700 |
| 25.0 | 1200 | 1200 | 1400 |
| 30.0 | 1200 | 1300 | 1400 |
| 35.0 | 1200 | 1300 | 1400 |
| 40.0 | 1200 | 1300 | 1400 |

FIG. 9

| TEMPERATURE [°C] | DISCHARGE-AMOUNT TARGET VALUE D [uA] |
|---|---|
| 5.0 | 100 |
| 10.0 | 80 |
| 15.0 | 50 |
| 20.0 | 40 |
| 25.0 | 20 |
| 30.0 | 20 |
| 35.0 | 20 |
| 40.0 | 20 |

FIG. 10

| TEMPERATURE [°C] | DISCHARGE-START-POINT CORRESPONDING BIAS |
|---|---|
| 5.0 | 2000 |
| 10.0 | 1800 |
| 15.0 | 1600 |
| 20.0 | 1400 |
| 25.0 | 1200 |
| 30.0 | 1200 |
| 35.0 | 1200 |
| 40.0 | 1200 |

IMAGE FORMING APPARATUS

TECHNICAL FIELD

The present invention relates to an image forming apparatus which is, for example, a copier, a printer, a facsimile, or a multifunction device having a plurality of functions of the aforementioned devices.

BACKGROUND ART

In an image forming apparatus of an electrophotographic system, there is known a method of removing a transfer remaining toner adhering to a photosensitive body by a cleaning blade. With a configuration using the cleaning blade, a cleaning failure may occur when an image with a low coverage rate is continuously output, when an image is continuously output on sheets with a relatively small size (for example, postcard size), or when an image is continuously output under a high-temperature and high-humidity environment. To be specific, since the amount of toner to be supplied to the cleaning blade is decreased, the cleaning blade may be curled up or chatter (stick-slip) may occur. Hence, there is known a method of restricting a cleaning failure by intentionally supplying a toner to the cleaning blade.

Also, in an image forming apparatus including a plurality of image forming units each having a photosensitive body and a cleaning blade, there is known an apparatus that can select one of modes and executes the selected mode, the modes including a mode for image formation by using all image forming units (for example, full-color mode) and a mode for image formation by using a selected image forming unit (for example, monochrome mode).

When the mode for image formation by using the selected image forming unit (for example, monochrome mode) is executed, it is desirable to bring the photosensitive body of the image forming unit not used for the image formation into contact with an intermediate transfer body, so that part of the photosensitive body not used for the image formation does not slide on the intermediate transfer body.

However, if the photosensitive body is rotated without image formation, the amount of toner to be supplied to the cleaning blade is decreased, and a cleaning failure could possibly occur.

PTL 1 discloses an image forming apparatus including a plurality of image forming units each having a photosensitive body and a cleaning blade. In particular, to address a cleaning failure in an image forming unit not used for image formation when a mode for image formation by using a selected image forming unit is executed, there is disclosed a configuration that intentionally supplies a toner to the cleaning blade of the image forming unit not used for the image formation during non-image formation in the mode.

In this case, when image formation is executed by using the selected image forming unit, the photosensitive body in the image forming unit not used for the image formation is usually rotated without charging, exposure, or development. When a toner is supplied to the cleaning blade, a charge bias and a development bias have to be raised.

In this case, in a configuration that develops an electrostatic image by using a developer containing a carrier and a toner, since a timing is controlled to restrict adhesion of the carrier to the photosensitive body, it takes a relatively long time to raise the charge bias and the development bias. The toner is no longer supplied to the cleaning blade within a period corresponding to a sheet interval that is an interval between a current recording material and a next recording material in case of continuous image formation. Hence, productivity may be decreased. Owing to this, there may be conceived a method of applying only the development bias without charging the photosensitive body (setting the charge bias at OFF and hence causing the photosensitive body to be 0 V), and supplying the toner to the cleaning blade in the sheet interval.

CITATION LIST

Patent Literature

PTL 1: Japanese Patent Laid-Open No. 2003-076103

SUMMARY OF INVENTION

Technical Problem

However, when a sequence execution time required for supplying the toner was decreased by supplying the toner to the cleaning blade of the image forming unit not used for image formation (not used for image formation for transfer on a recording material), the following problem has occurred.

In particular, an image defect was generated such as a lack of part of an image output by an image forming unit located downstream of an image forming unit not used for image formation in a moving direction of an intermediate transfer body.

Then, the inventor studied about the phenomenon, and found that a photosensitive body after a toner supplied on the photosensitive body by applying only a development bias was removed by the cleaning blade was unintentionally charged with electricity by separation discharge.

That is, it is expected that the above-described image defect is resulted from a carrier adhering to the photosensitive body since the potential of the photosensitive body not for image formation is changed by separation discharge. Also, it could be conceived that the carrier adhering to the photosensitive body adhered to the intermediate transfer body, and the carrier interrupted transfer of a toner image formed by the image forming unit located downstream of the image forming unit not for image formation in the moving direction of the intermediate transfer body.

In an image forming apparatus including a plurality of image forming units and executes a mode for image formation by using a selected image forming unit, an object of the invention is to provide an image forming apparatus that can restrict a decrease in productivity and restrict an image defect such as a lack of part of an image output during the execution of the mode.

Solution to Problem

Accordingly, an image forming apparatus according to the invention includes "a first image forming unit including a rotatable first photosensitive body, a first charger configured to charge the first photosensitive body with electricity, a first exposure unit configured to expose the charged first photosensitive body to light and form an electrostatic latent image on the first photosensitive body, and a first developing unit configured to develop the electrostatic latent image formed on the first photosensitive body by using a developer containing a toner and a carrier and form a toner image;

a second image forming unit including a rotatable second photosensitive body, a second charger configured to charge the second photosensitive body with electricity, a second exposure unit configured to expose the charged second photosensitive body to light and form an electrostatic latent image on the second photosensitive body, and a second developing unit configured to develop the electrostatic latent image formed on the second photosensitive body with a toner and form a toner image;

a movable intermediate transfer body on which the toner images formed on the first and second photosensitive bodies are transferred at a first transfer portion located downstream of the first developing unit and upstream of the first charger in a rotation direction of the first photosensitive body and at a second transfer portion located downstream of the second developing unit and upstream of the second charger in a rotation direction of the second photosensitive body;

a third transfer portion configured to transfer the toner images transferred on the intermediate transfer body, on a recording material;

a cleaning blade configured to contact the first photosensitive body at a position located downstream of the first transfer portion and upstream of the first charger in the rotation direction of the first photosensitive body and remove the toner adhering to the first photosensitive body; and an execution unit that executes a mode for execution of image formation with transfer on a recording medium by using the second image forming unit without using the first image forming unit in a state in which the first and second photosensitive bodies are in contact with the intermediate transfer body, wherein the first transfer portion is located upstream of the second transfer portion in a moving direction of the intermediate transfer body and downstream of the third transfer portion, and the execution unit includes a control unit configured to execute, during the execution of the mode, toner supply control that causes the toner to adhere to a region on the photosensitive body which does not contact a region on the intermediate transfer body on which the toner image formed by the second image forming unit is to be transferred, and supplies the toner to the cleaning blade by applying a development bias to the first developing unit without applying a direct-current voltage to the first charger, and that applies an alternating-current voltage to the first charger when at least the region on the first photosensitive body from which the toner is removed by the cleaning blade passes through the first charger."

Advantageous Effects of Invention

Reduction in productivity can be restricted, and an image defect such as a lack of part of an image output during the execution of the mode for image formation by using the selected image forming unit can be restricted.

BRIEF DESCRIPTION OF DRAWINGS

FIG. 7 is a table showing sampling points of non-discharge regions according to the example.

FIG. 8 is a table showing sampling points of discharge regions according to the example.

FIG. 9 is a table showing targets of discharge amounts according to the example.

FIG. 10 is a table with a list of discharge-start voltage values in respective environmental atmosphere states, obtained through experiments according to the example.

DESCRIPTION OF EMBODIMENTS

Hereinafter, a general configuration of an image forming apparatus is described, and then a charging device is described in detail with reference to the drawings. It is to be noted that the applicable ranges of the dimensions, materials, shapes, relative positions, and so forth, of components according to this technical idea are not limited to those described below unless otherwise those are particularly specifically written.

Example 1

First, a general configuration of an image forming apparatus is briefly described, and then a charging device (corona charger) according to this example is described in detail.

Section 1. Entire Configuration of Image Forming Apparatus

Figure 1:
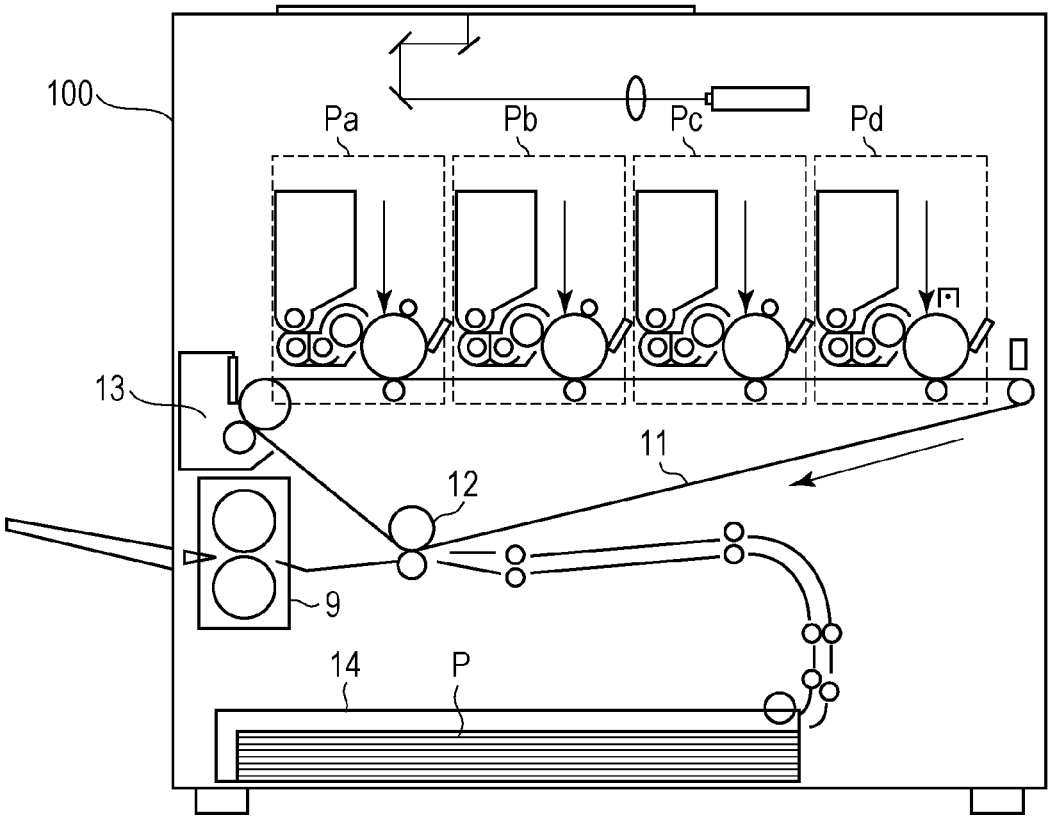
FIG. 1 is a schematic illustration of a general configuration of an image forming apparatus according to an example.
Figure 2:
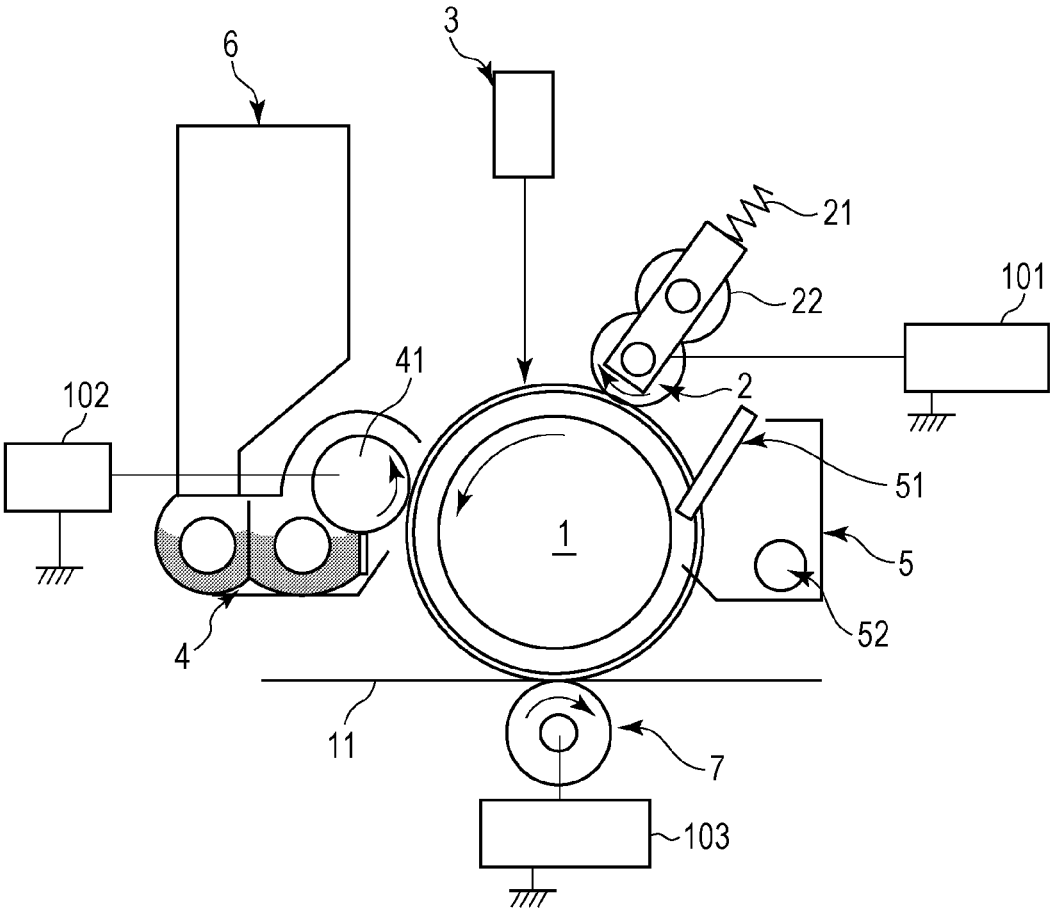
FIG. 2 is an illustration for explaining an image forming unit according to the example.

FIG. 1 is a schematic illustration showing a general configuration of a color image forming apparatus of a tandem intermediate transfer system according to this example. Also, FIG. 2 is an illustration for explaining an image forming unit. Provided in this case is a color copier of an electrophotographic system in which a charge system of the image forming apparatus according to this example is so-called contact charge system, and a development system employs a two-component development system.

As shown in FIG. 1, an image forming apparatus 100 of this example includes four image forming stations Pa, Pb, Pc, and Pd (image forming units) arranged in series in an image sending direction.

The image forming stations are described below. The image forming stations Pa, Pb, Pc, and Pd have common configurations. In particular, the common configuration of each image forming station includes a photosensitive drum 1 serving as a photosensitive body, a charging roller 2 serving as a charger, and a developing device 4 serving as a developing unit that houses a developer containing a toner and a carrier and develops an electrostatic image. Also, a cleaning blade 5 serving as cleaning means for removing a transfer remaining toner remaining on the photosensitive body and cleaning the photosensitive body is included. The photosensitive drum 1 of this example used a negative-charge organic photoconductor (OPC) having a rotary drum shape and being an electrophotographic photosensitive body with an outer diameter of 30 mm. Also, the photosensitive drum 1 is rotationally driven by a motor (not shown) serving as driving means, at a process speed (peripheral speed) of 350 mm/sec in a direction indicated by an arrow R1 when a full-color image is formed on a sheet of normal paper.

Also, a scanner 3 serving as an exposure unit that exposes the charged photosensitive drum to light and forms an electrostatic image, a toner supply device (toner cartridge) 6 that supplies a toner to the developing unit, and a transfer roller 7 serving as transfer means are included. The transfer roller 7 is applied with a transfer bias from a high-voltage power supply 103 serving as applying means, and a toner image on the photosensitive body is transferred on an intermediate transfer belt at a transfer portion. However, the image forming station Pd located at the most downstream side in a moving direction of the intermediate transfer belt used a corona charger. Also, the most downstream image forming station Pd (black) may employ so-called jumping development system or other development system.

The photosensitive drum 1 being rotationally driven is charged with electricity by the charging roller 2 that is supplied with a bias from a high-voltage power supply 101 serving as applying means. Since the charging roller 2 contacts the photosensitive body, the charging roller 2 is cleaned by a cleaning roller 22 serving as a cleaning member that cleans the surface of the charging roller. The charging roller 2 and the cleaning roller 22 are integrally provided and are urged by a spring 21 toward the photosensitive body.

Then, the exposure device 3 forms an electrostatic latent image on the drum surface of the photosensitive drum 1 charged with electricity as described above. The exposure device 3 is formed of a light source device and a polygonal mirror (not shown). Laser light emitted from the light source device provides scanning through the polygonal mirror, and an electrostatic latent image (electrostatic image) corresponding to an image signal is formed on the photosensitive drum 1.

The surface of the photosensitive drum 1 with the electrostatic latent image formed thereon faces the developing device 4 by rotation of the photosensitive drum 1. A development bias is applied to a development sleeve 41, and the electrostatic image on the photosensitive body is developed with a toner. The developing device 4 houses a two-component developer by a predetermined amount. A non-magnetic toner of one of yellow, magenta, and cyan and a magnetic carrier are mixed in the two-component developer with a predetermined mixture ratio. Also, the toner cartridge 6 houses the non-magnetic toner, and supplies the developing device with the non-magnetic toner in accordance with the use amount of the non-magnetic toner from the inside of the developing device.

The toner image formed on the surface layer of the photosensitive drum by the developing device 4 is first transferred on an intermediate transfer belt 11 serving as an intermediate transfer body, at the transfer portion by the transfer roller 7 serving as transfer means. In contrast, the toner remaining on the photosensitive drum 1 is removed and collected by the cleaning blade 5 of each image forming unit.

The toner image formed by the above-described image forming station and transferred on the intermediate transfer belt 11 is second transferred on a transfer material P serving as a recording material by a second transfer roller 12, the transfer material P which is conveyed from a cassette 14. Also, the toner adhering to the surface of the intermediate transfer belt 11 at a position located downstream of the transfer portion, at which the toner image is transferred on the transfer material P, is cleaned up by a belt cleaning device 13.

The transfer material P which has passed through the second transfer portion is heated and pressed by a fixing roller 9 serving as fixing means, and hence the toner image is fixed to the transfer material P. The transfer material P with the toner image fixed is output to a sheet output tray arranged outside the apparatus.

The image forming apparatus of this example selects the process speed and various conditions in accordance with an image formation mode. For example, when an image is formed on a thick sheet such as a sheet with a basis weight larger than 120 g/m$^2$, an operation is made in a low-speed mode, in which the process speed is lowered. An operation during execution of such a mode is described later in detail.

Section 2. Setting Conditions of Various Image Forming Elements

Then, specific conditions of elements relating to various images are described below.

The charging roller 2 is rotated by rotation of the photosensitive drum 1. A core bar of the charging roller 2 is applied with a charge bias voltage under a predetermined condition by the high-voltage power supply 101 serving as applying means. Accordingly, the surface of the rotating photosensitive drum 1 is processed by contact charging at a predetermined polarity and a predetermined potential. In this example, a charge bias voltage for the charging roller 2 is an oscillation voltage in which a direct-current voltage and an alternating-current voltage are superimposed. To be more specific, in image formation under a normal temperature environment at a temperature of 23° C. and a relative humidity of 50%, the charge bias voltage is an oscillation voltage in which a direct-current voltage of −700 V and an alternating-current voltage of a sinusoidal wave with a frequency of 2.0 kHz and f-to-peak voltage Vpp=1.5 kV are superimposed. With this charge bias voltage, the surface of the photosensitive drum 1 is uniformly charged at −700 V (dark potential Vd) that is the same as the direct-current voltage applied to the charging roller 2.

The development sleeve 41 is applied with a predetermined development bias from a high-voltage power supply 102 serving as applying means. In this example, the development bias voltage is an oscillation voltage in which a direct-current voltage and an alternating-current voltage are superimposed. To be more specific, the development bias voltage is an oscillation voltage in which a direct-current voltage of −550 V and a rectangular-wave alternating-current voltage with a frequency of 9.0 kHz and peak-to-peak voltage Vpp=1.8 kV are superimposed. With the development bias and an electric field of the electrostatic latent image formed on the surface of the photosensitive drum 1, the electrostatic latent image is developed in an inverted manner.

The toner image developed on the photosensitive drum is first transferred on the intermediate transfer belt 11 by the transfer device 7 at the transfer portion. In contrast, the first transfer remaining toner etc. remaining on the photosensitive drum 1 is collected by the cleaning device 5.

The cleaning device 5 includes a cleaning blade 51 that contacts the photosensitive drum with a pressure, a conveying screw 52 that conveys the toner, and a waste toner box (not shown) that collects a waste toner. The waste toner, which is obtained when the transfer remaining toner adhering to the surface of the photosensitive drum is scraped by the cleaning blade, is conveyed to the waste toner box (not shown) by the waste-toner conveying screw. A contact pressure of the cleaning blade in this example is 50 gf/cm. With regard to this contact pressure, the rotation torque of the photosensitive drum is normally set at 3 to 4 kgf·cm. Finally, the interval of transfer positions of the photosensitive drums included in the respective image forming stations Pa, Pb, Pc, and Pd (transfer pitch) is 120 mm.

Section 3. Contact/Separation Mechanism and Image Formation Mode

The image forming apparatus of this example selects one of a plurality of image formation modes and executes the selected mode. The plurality of image formation modes include a full-color mode for forming an image by using toners of all colors (first mode), and a monochrome mode for forming an image only with a black toner (second mode).

Also, the contact/separation mechanism is provided. When the image forming apparatus of this example executes image formation only with the image forming station Pd (monochrome mode), the contact/separation mechanism brings the photosensitive drum of Pd into contact with the intermediate transfer belt 11 and separates the photosensitive drums of Pa, Pb, and Pc from the intermediate transfer belt 11. When an image is formed by all the image forming stations Pa, Pb, Pc, and Pd (full-color mode), all photosensitive drums are brought into contact with the intermediate transfer belt by the above-described mechanism.

In this example, Yellow, Magenta, Cyan, and Black are used for the image forming stations Pa, Pb, Pc, and Pd arranged in that order. Hence, when image formation with a single color of Black is executed (monochrome mode), Pa, Pb, and Pc are separated from the intermediate transfer belt 11, and in each of the separated image forming stations, rotational driving and application of voltages such as the charge bias and the development bias are stopped.

Also, as described above, when a thick sheet or a special sheet, such as OHP or an embossed sheet, passes while using a single color of Black, a low-speed mode in which rotational driving is provided at a process speed of 175 mm/s being a half of 350 mm/s is executed. In execution of the low-speed mode, the image forming apparatus of this example does not cause the image forming stations not used for image formation to be separated from the intermediate transfer body even in the monochrome mode. This is to ensure banding with an equivalent level for a plurality of speed modes.

In other words, while the image forming apparatus of this example includes the contact/separation mechanism that switches the contact and separation, if the low-speed mode and the monochrome mode are selected and executed, the photosensitive drums included in all the image forming stations are held to be in contact with the intermediate transfer belt. Also, an idea similar to this case may be applied to a configuration in which a photosensitive body that does not execute image formation is rotated due to a configuration not including the contact/separation mechanism or a relationship of a gear train (drive train).

In this case, in any of the image forming stations Pa to Pc that do not execute image formation, the photosensitive drum 1 is rotationally driven, however, application of various biases is continuously stopped.

In this situation, the photosensitive drums continuously rotate without the toner supplied to the cleaning blades of the stations of Y, M, and C that do not execute image formation. That is, the toner that functions as a lubricant is not supplied to the cleaning blade for a long period. Hence, the cleaning blade may be likely curled up or chatter may likely occur in this situation.

Section 4. Timing for Execution of Toner Supply

Next, a timing at which a toner supply sequence to the cleaning blade is executed is briefly described. As described above, when the amount of transfer remaining toner to be supplied during image formation is small, it is desirable to supply the toner to the cleaning blade to restrict a cleaning failure. The amount of transfer remaining toner varies in accordance with an image to be formed on a sheet (the amount of toner). Hereinafter, a procedure of determining an execution timing of toner supply by a control circuit is described.

Execution Trigger of Toner Supply Sequence

In this example, an image Duty, which is one of indexes of the amount of toner to be transferred on a sheet served as an execution trigger of the sequence. In this example, when an image Duty with a solid density, which is the maximum density available for image formation, is provided in an area of 10 mm×297 mm on a single sheet with A4 size (210 mm×297 mm), this case is defined as 1/210 [unit/sub-scanning length mm], and is used in the following description.

A driving load of the photosensitive drum in this example is 3 to 4 kgf·cm if the image Duty is 3/42000 [unit/sub-scanning length mm] or larger. However, if the image Duty is smaller than 3/42000 [unit/sub-scanning length mm], the rotation torque (driving load) of the photosensitive drum becomes constantly 4 kgf·cm or larger as the number of accumulated sheets of image formation increases. In this way, if the driving load of the photosensitive drum exceeds 4 kgf·cm, chatter and curl may be likely generated.

Owing to this, the image forming apparatus of this example is controlled by a controller to supply the toner with the image Duty being 3 [unit/sub-scanning length mm] is supplied to the cleaning blade every 200 sheets when converted according to the number of A4 passing sheets. Alternatively, without managing the average value of the image Duty, a change in surface resistance of the photosensitive body may be acquired from a current value of current that is applied to the motor to rotationally drive the motor at a predetermined speed.

Explanation for Toner Supply Sequence with Flowchart

Described below with a flowchart is a toner supply sequence in a mode at least one of the stations does not execute image formation while the photosensitive bodies of the image forming stations Pa to Pd being the image forming units are in contact with the intermediate transfer belt. To be more specific, the description is given for the monochrome mode in which only the Bk station Pd (second image forming unit) located at the most downstream side in the moving direction of the intermediate transfer belt executes image formation, but the Y, M, and C stations Pa to Pc (first image forming units) located upstream of the Bk station Pd do not execute image formation.

Figure 6:
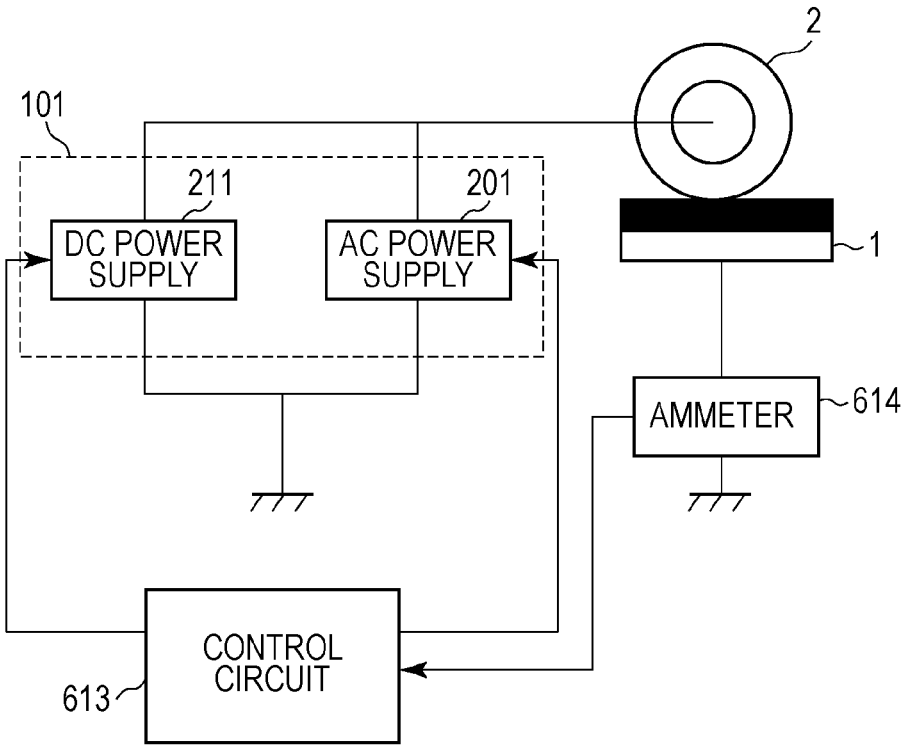
FIG. 6 is a block diagram of the image forming apparatus according to the example.

The image forming apparatus of this example includes a control circuit 613 serving as an execution unit and a control unit that control respective elements of the image forming apparatus. The control circuit 613 receives information from detecting means such as an ammeter and controls biases to be applied to the elements and driving of the elements (see FIG. 6).

Figure 3:
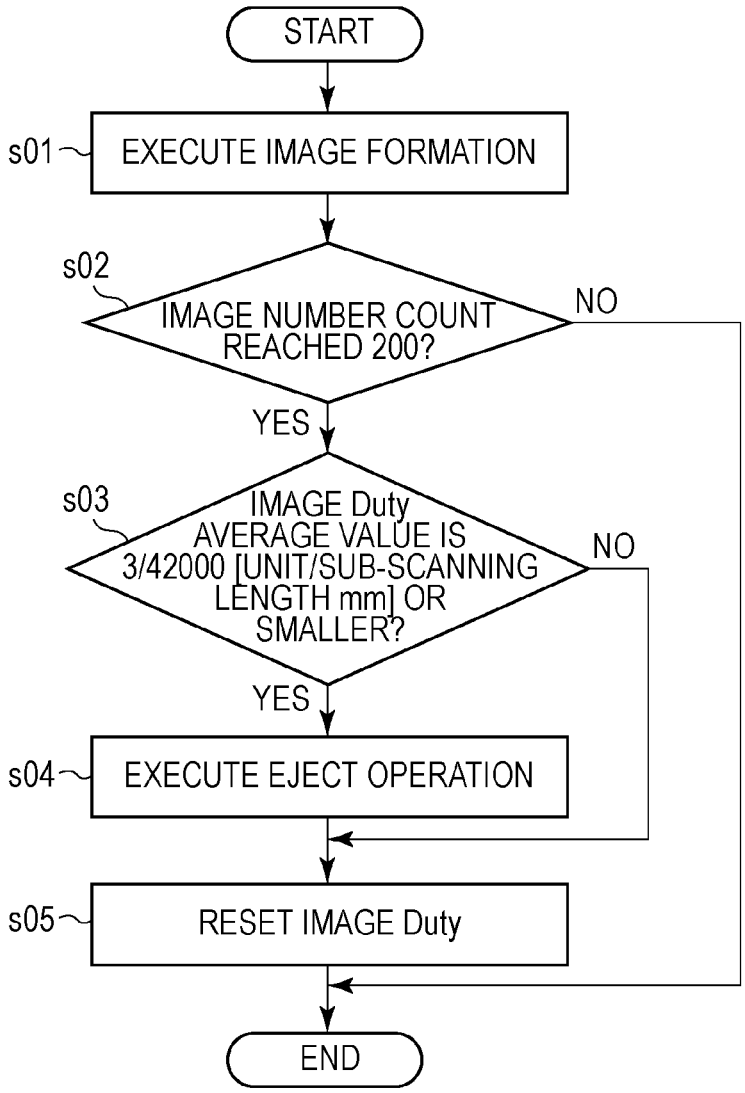
FIG. 3 is a flowchart for explaining an eject operation according to the example.

FIG. 3 is a rough flowchart of a sequence for supplying a toner to the cleaning blade to increase lubrication performance to restrict a cleaning failure. Respective steps are described below.

The control circuit serving as the controller provides control to execute image formation in the Bk station (s01). Then, the control circuit determines whether or not the number of sheets of image formation has reached 200 sheets when converted into A4 sheets (s02). If the number of sheets does not reach 200 sheets, the control circuit continues image formation since the current timing is not a timing at which the toner is supplied to the cleaning blade (END). In contrast, if the number of sheets has reached 200 sheets, the control circuit determines whether or not an average value of the image Duty for a predetermined period is smaller than 3/42000 [unit/sub-scanning length mm] (s03). If the average value of the image Duty is equal to or larger than 3/42000 [unit/sub-scanning length mm], the control circuit resets a counter that holds the image Duty (s05). In contrast, if the average value of the image Duty is smaller than 3/42000 [unit/sub-scanning length mm], the control circuit executes an eject operation of a lubrication toner to the cleaning blade at a position corresponding to an area between sheets during image formation (s04). At this time, the ejected toner amount is an insufficient amount by which the measured image Duty is insufficient as compared with 3 [unit/sub-scanning length mm]. For ejection of 3 [unit/sub-scanning length mm] at maximum, the required time is about 0.1 [s]. In this example, the image Duty is reset every 200 sheets. However, the reset does not have to be limited to this method.

Section 5. Toner Supply Operation

Next, an operation of supplying a toner to the cleaning blade to increase lubrication performance is described with a timing chart.

Figure 4:
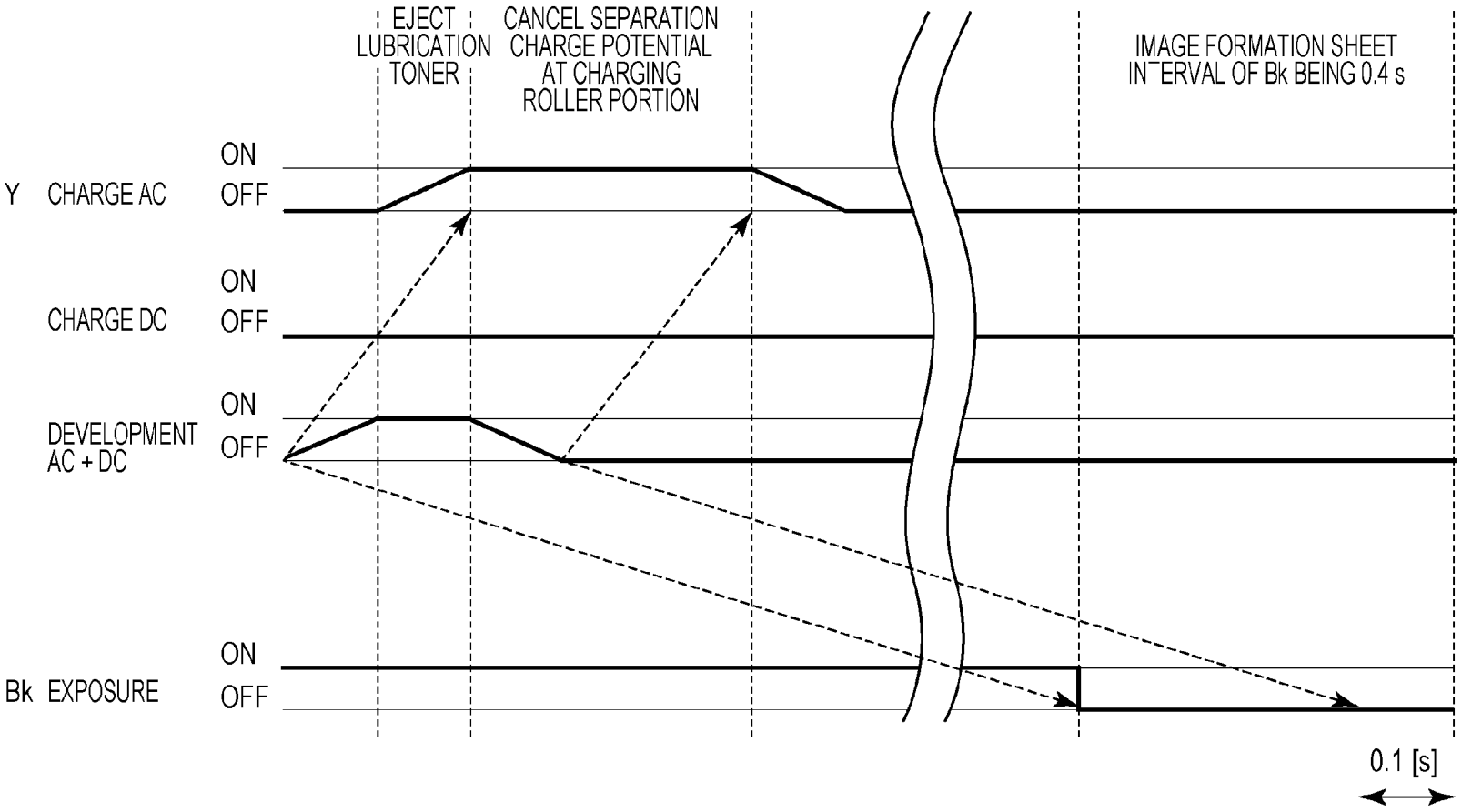
FIG. 4 is a timing chart for explaining an eject operation of an upstream image forming unit, image formation of a downstream image forming unit, and a sheet interval timing according to the example.
Figure 5:
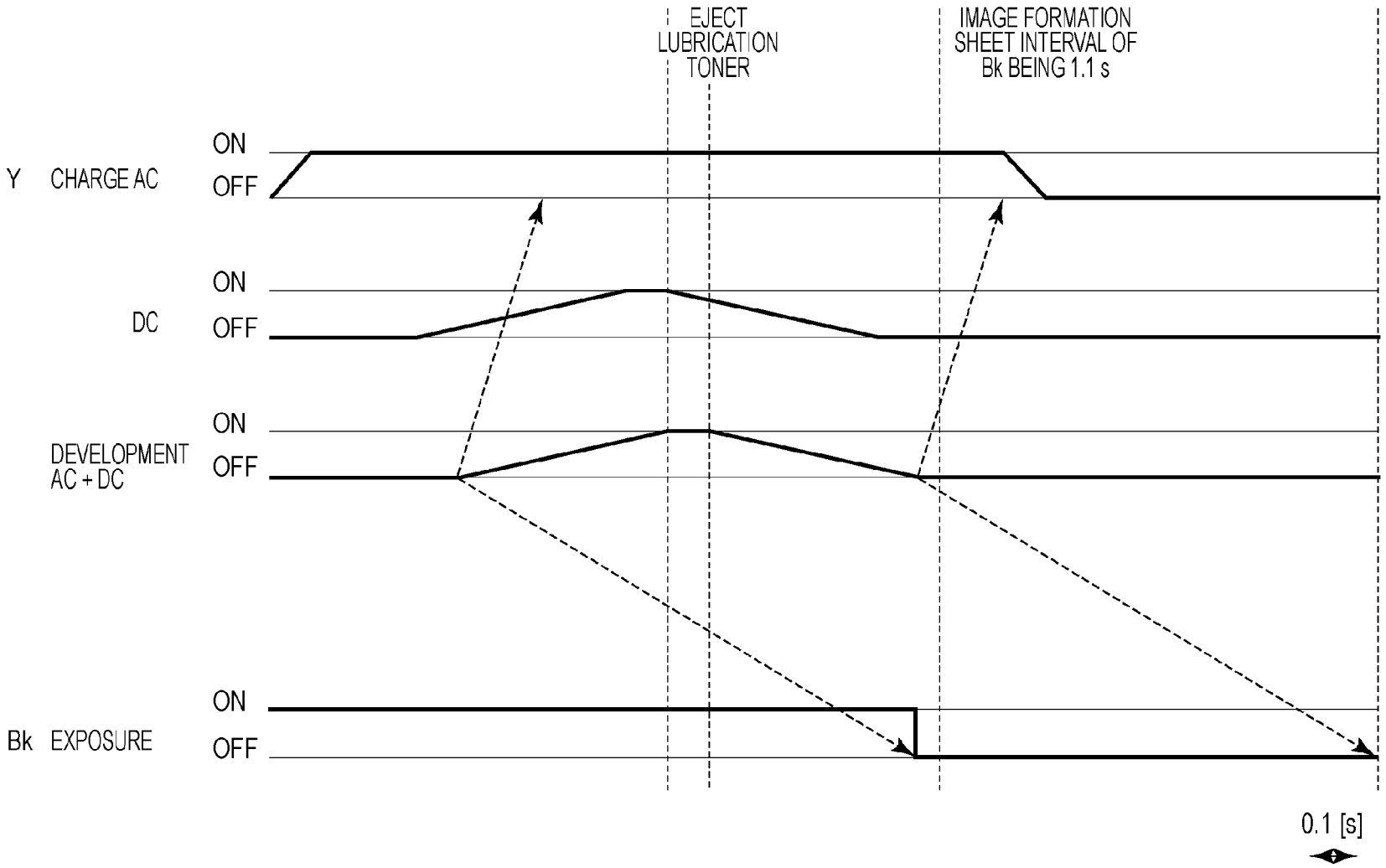
FIG. 5 is a timing chart for explaining an eject operation of an upstream image forming unit, image formation of a downstream image forming unit, and a sheet interval timing when an eject operation is executed in a normal image formation operation according to a comparative example.

FIG. 4 is a timing chart when the toner is supplied to the cleaning blade of this example. Also, FIG. 5 is a timing chart when a toner is ejected similarly to ejection during image formation, according to a comparative example.

Overview of Toner Supply Operation

As described above, the process speed of the image forming apparatus of this example is 350 mm/s, the diameter of the photosensitive drum is ϕ30 mm for each of the image forming stations Pa, Pb, Pc, and Pd. Regarding the positions of the developing device and the charging device facing the surface of the photosensitive drum while a position facing the intermediate transfer belt serves as a reference being 0 mm, the development position is located at the upstream side by ⅓ turn of the photosensitive drum from the positional reference (upstream by 31.4 mm), and the charge position is located at the upstream side by ⅓ turn from the development position (upstream by 62.8 mm).

Also, it is assumed that the exposure position of Pd is located at the upstream side by ½ turn from the positional reference, that is, 125.7 mm. Also, the distance between the transfer positions of the respective image forming stations (transfer pitch) is 120 mm.

Also, regarding rising for application of a DC component for only the development bias, the slope for rising and falling requires a time of 0.1 [s]. Similarly, rising and falling for charge AC requires a time of 0.1 [s]. For exposure of the Bk station, it is assumed that rising takes substantially zero seconds. The process speed in this example is 350 mm/s, and the sheet interval of continuous passing sheets is 0.4 [s].

At this time, FIG. 4 shows the timing chart of the eject control that is executed in this example. To increase the lubrication performance to the cleaning blade, the time required for ejecting the toner by the amount of toner to be supplied to the cleaning blade on the photosensitive body is 0.1 [s]. Hence, with regard to rising and falling of development DC, the time from the start to the end is 0.3 [s]. This time is less than 0.4 [s] that is the sheet interval required time of Bk. Therefore, the ejection can be executed during the sheet interval.

Next, a comparative example is briefly described. FIG. 5 is the timing chart of the comparative example in which a toner image is formed on a photosensitive body by charging the photosensitive body with electricity and exposing the photosensitive body to light like a situation during image formation. During normal image formation, rising and falling of development DC bias and charge DC bias take a time of 0.5 [s] to prevent overlap due to a timing shift of development and charge. Hence, a period from when rising of development DC is started, then ejection for 0.1 [s] at maximum is executed, to when development DC falls takes 1.1 [s]. That is, a time required for forming a toner to be supplied to the cleaning blade, on the photosensitive body (ejection) is 1.1 [s]. Hence, the time required for ejection exceeds 0.4 [s] being the sheet interval required time. Owing to this, if the toner supply operation described in the comparative example was employed, it was not possible to form a toner strip in a sheet interval without decreasing productivity.

Comparison Between Example and Comparative Example

To restrict curl or chatter of the cleaning blade that contacts the photosensitive body rotated by the rotation of other station not used for image formation, the difference between the case in which a charge DC voltage of 700 V is applied similarly to the situation during image formation (comparative example) and this example is described with Table 1.

TABLE 1

| | | Required time [s] | Sheet interval time [s] | Length relationship with sheet interval time |
|---|---|---|---|---|
| Way of ejecting lubrication toner | Similar to image formation operation | 1.05 | 0.34 | 1.05 > 0.34 (ejection is impossible within sheet interval time) |
| | Example | 0.3 | | 0.3 < 0.34 (ejection is possible within sheet interval time) |

As shown in Table 1, the time required for toner ejection in the normal image formation operation takes 1.1 [s], but is 0.3 [s] in the eject control executed in this example. Hence, the toner supply operation of this example can provide an output by an extremely short time. That is, the image forming stations Pa, Pb, and Pc at the upstream side not used for image formation can execute the ejection sequence while the image forming station Pd at the downstream side executes the image formation operation. Therefore, the ejected toner can pass in the sheet interval of Pd that executes image formation without downtime.

In the case of low speed, the rising times of the development and charge biases are the same, and the time required for ejection is increased by the value of process speed. In this example, to execute ejection with 3 [unit] in terms of image Duty, the ejection takes 0.4 [s]. In contrast, the time required for a sheet interval is 0.8 [s]. If the ejection in this example is executed, the ejection is executed within the sheet interval. In contrast, if the ejection is executed in the normal image formation operation, the time required for the ejection is 1.2 [s]. The ejection is not within 0.8 [s] which is the sheet interval time at low speed.

Section 6. Charge Bias Before and after Toner Supply

As described above, if the toner is supplied to the cleaning blade without application of a direct-current voltage to the charging roller, the supply of the toner can be completed within a short time as compared with the comparative example. However, it was found that if the toner formed on the photosensitive body is removed by the cleaning blade without the photosensitive body being charged with electricity, the potential at the surface of the photosensitive body in a portion from which the toner is removed may become unstable by separation discharge. Hence, the control circuit controls the bias during the operation for supplying the toner to the cleaning blade and the bias subsequent to the toner supply operation as follows.

Various Biases During Toner Supply Operation

First, development DC, development AC bias, and charge AC bias that are applied when the toner is supplied to the cleaning blade (during ejection) are described.

The control circuit applies a predetermined development DC voltage (development bias) to the developing device to obtain Vcont with a solid density. In this example, a voltage of −200 V is applied to the developing device when the toner is supplied to the cleaning blade. Also, in this example, an alternating-current voltage of 1400 Vpp is applied to the developing device to ensure development performance to the photosensitive body.

Then, the charge bias to be applied to the charging roller during the toner supply operation is described. As described above, when the toner is supplied to the cleaning blade, an alternating current voltage whose peak-to-peak voltage value is at least about twice a discharge-start voltage value is applied without applying a direct-current voltage to the charging roller. In this example, the ON timing of the alternating-current voltage is after the toner eject operation and is turned ON at a timing at which the ejection region passes the charging portion for the first time. However, it is not limited thereto. The electricity may be eliminated before the image forming unit with the eject operation executed executes image formation for the next time. Also, regarding the ON timing of the alternating-current voltage, for example, there may be a configuration that advances the ON timing of the alternating-current voltage to eliminate electricity so that the potential on the drum is previously set at 0 V before the eject operation. However, a configuration is basically preferably that turns OFF the alternating-current voltage except when required.

In this case, not applying a direct-current voltage to the charging roller substantially includes applying a direct-current voltage of substantially 0 V to the charging roller. The direct-current voltage that is applied to the charging roller is to prevent the carrier from adhering to the photosensitive body from the developing device during rising and falling of a bias. Hence, it is assumed that a direct-current voltage that is applied to the charging roller is substantially turned OFF as long as the direct-current voltage is within a range (about 0±30 V) in which the carrier to the photosensitive body can be restricted when the toner is supplied to the cleaning blade. When the toner is ejected to the photosensitive body, the alternating-current that is applied to the charging roller (AC charge bias) preferably has a discharge current amount of 0 or larger. A method of determining the alternating-current voltage that is applied to the charging roller in this case is described later.

Charging Processing for Region after Toner Removal

Described next is various biases after the toner ejected on the photosensitive body to restrict a cleaning failure is removed. Based on the study of the inventor, it was found that, when the toner ejected on the photosensitive body was removed by the cleaning blade, the potential of the region from which the toner of the photosensitive body was removed by the cleaning blade was changed. To be specific, if the charging polarity of the toner was negative, regarding the toner ejected by application of the development bias, the potential of the photosensitive body in the region from which the toner was removed by the cleaning blade unit tended to be charged with the reverse polarity (positive) reversal to the charging polarity of the toner. This may be because the potential of the region from which the toner was removed was changed since the toner was removed by the cleaning blade from the electrically balanced state (0 V) when the charged toner is held on the photosensitive body.

As described above, due to the change in potential generated when the toner supplied to the cleaning blade is cleaned up, if the development bias applied to the developing device is turned OFF, the following problem may occur. To be specific, when the region of the photosensitive body after the removal of the supplied toner passes through the development nip, a local contrast potential may cause overlap of the toner and adhesion of the carrier as the result of attraction of the toner with the carrier to the drum. If the potential of the region after the separation discharge was measured by a potential sensor, the result of a markedly large potential could not be obtained. A detailed mechanism of adhesion of the carrier is not figured out; however, the reason may be as follows. That is, the region after the separation discharge is leveled in a macro view with the potential sensor, and the potential is not a markedly large potential. However, in a micro view, the potential is largely deflected in a needle shape, Vcont is locally increased, and hence the carrier may adhere. The toner and carrier adhering on the photosensitive body affects an image of a station located downstream of the image forming station that executes the toner supply mode to restrict a cleaning failure.

Hence, the control circuit of this example applies the various biases at the following timing to restrict occurrence of an image defect by providing control on the image defect generated at the downstream side after the toner supply, as follows.

As shown in FIG. 4, after the control circuit of this example executes the toner eject operation for lubrication, the control circuit applies the AC voltage to the charging roller, and hence the potential of the photosensitive body changed by the separation discharge is converged at a predetermined potential (substantially 0 V). The direct-current voltage that is applied to the charging roller is 0 V (not applied), and the alternating-current voltage whose peak-to-peak voltage value is about twice the discharge-start voltage value is applied. Accordingly, the alternating-current voltage near the discharge-start value (Vth±about 100 V) is applied to the charging roller, and the surface potential of the photosensitive body becomes about the direct-current voltage value that is applied to the charging roller. If a target is set at the discharge current value being substantially 0 μA, when image formation is executed, a line-shaped image defect caused by discharge unevenness is generated. However, when the region of the photosensitive body after the toner removal is set at substantially 0 V, even if the discharge unevenness is generated by a certain degree, an image is not output, and hence the affection is less.

Therefore, when the region of the photosensitive body from which the supplied toner is removed passes through the charging nip, the control circuit of this example does not apply the direct-current voltage to the charging roller, but applies the alternating-current voltage whose peak-to-peak voltage value is about twice the discharge-start voltage value, which is lower than the peak-to-peak voltage value of the alternating-current voltage to be applied during image formation.

Accordingly, a good image can be output while restricting a decrease in productivity when the load on the cleaning blade is large. The region in which the separation discharge is expected to occur by removal of the toner strip by the cleaning blade has a width in which the toner strip is formed. Owing to this, at least during a period in which the region, from which the toner strip formed to restrict a cleaning failure is removed, passes, DC=0 V and the alternating-current voltage of about the discharge-start voltage value are preferably applied to the charging roller. The control circuit of this example was controlled to turn OFF the alternating-current voltage that is applied to the charging roller after one turn of the photosensitive drum since the rear end of the toner strip for supply to the cleaning blade passed through the charging nip in view of safety.

Additional Explanation for Method of Obtaining Discharge Current Amount and Discharge-Start Voltage Value A method of obtaining a discharge current amount and a discharge-start voltage value is described below according to an example. Of course, other known method may be used to obtain the discharge current value and the discharge-start voltage value.

In this example, the discharge-start voltage value etc. was obtained as follows. To be more specific, when a constant AC voltage is applied from an AC power supply 201 to the charging roller 2, a current-voltage characteristic (hereinafter, VI characteristic) of the charging roller is obtained on the basis of the AC current value detected by an ammeter 614. Then, by adding predetermined numerical calculation to the obtained VI characteristic by the control unit 613, an output of an AC component that satisfies a predetermined discharge amount table (not shown) is determined.

During image formation, an independently determined DC bias is applied from the DC power supply 211 in a superimposed manner with the AC power supply 201. The control unit 613 includes the above-described bias control unit.

Also, the numerical calculation to be added to the VI characteristic is specifically executed as follows.

First, application of a bias that does not cause discharge, that is, a bias in a non-discharge region is applied, and the VI characteristic at this time is obtained. That is, a linear approximation is calculated on the basis of the result of the current output to plural points of samplings Vpp.

Similarly, when the current output to the samplings Vpp are acquired also in the discharge region and the line obtained by the approximation in the non-discharge region is superimposed on the VI characteristic, the difference corresponds to a charge amount generated between the charging roller and the photosensitive drum.

Hereinafter, a procedure of obtaining a predetermined discharge amount is described with reference expressions.

First, it is assumed that non-discharge region samplings Vpp are (AC[1]', AC[2]', AC[3]'), and current values detected upon application of the bias are (Iac[1]', Iac[2]', Iac[3]'). At this time, an inclination a of the linear application in the non-discharge region, and an intercept b thereof are expressed by the following expression.

[Math. 1]

$$a = \frac{3\sum_{k=1}^{3} AC[k]' * Iac[k]' - \sum_{k=1}^{3} AC[k]' \sum_{k=1}^{3} Iac[k]'}{3\sum_{k=1}^{3} AC[k]'^2 - \left\{\sum_{k=1}^{3} AC[k]'\right\}^2}$$

$$b = \frac{3\sum_{k=1}^{3} AC[k]'^2 \sum_{k=1}^{3} Iac[k]' - \sum_{k=1}^{3} AC[k]' Iac[k]' \sum_{k=1}^{3} AC[k]'}{3\sum_{k=1}^{3} AC[k]'^2 - \left\{\sum_{k=1}^{3} AC[k]'\right\}^2}$$

When the discharge region samplings Vpp are (AC[1], AC[2], AC[3]) and the current values detected upon application of the bias are (Iac[1], Iac[2], Iac[3]), an inclination A of the linear approximation in the discharge region, and an intercept B thereof are expressed by the following expression.

[Math. 2]

$$A = \frac{3\sum_{k=1}^{3} AC[k]' * Iac[k]' - \sum_{k=1}^{3} AC[k]' \sum_{k=1}^{3} Iac[k]'}{3\sum_{k=1}^{3} AC[k]'^2 - \left\{\sum_{k=1}^{3} AC[k]'\right\}^2}$$

$$B = \frac{3\sum_{k=1}^{3} AC[k]'^2 \sum_{k=1}^{3} Iac[k]' - \sum_{k=1}^{3} AC[k]' Iac[k]' \sum_{k=1}^{3} AC[k]'}{3\sum_{k=1}^{3} AC[k]'^2 - \left\{\sum_{k=1}^{3} AC[k]'\right\}^2}$$

Also, when D is a desirable discharge amount, Vpp that satisfies D can be obtained by the following expression with a difference of the linear approximation formed of Expressions (6) and (7), and (8) and (9). D is an amount that varies also depending on the temperature and the amount of moisture in the atmosphere.

$$Vpp=\{D-(B-b)\}/(A-a) \quad \text{[Math. 3]}$$

In this example, the sampling points in the non-discharge region (AC[1]', AC[2]', AC[3]') and the sampling points in the discharge region (AC[1], AC[2], AC[3]) were determined as shown in FIGS. 7 and 8 with reference to the temperature. Also, a discharge-amount target value D was determined as shown in FIG. 9 with reference to the temperature.

As described above, the lowest voltage value, which is to be applied to the charging roller for causing discharge between the photosensitive body and the charging roller can be calculated in accordance with the impedance of the charging roller through energization and the temperature and humidity of the atmosphere environment.

Example 2

Example 1 disclosed the configuration that, when the potential of the photosensitive body varies due to the separation discharge caused by removal of the toner, executes control to obtain the discharge-start voltage value and applies the alternating-current voltage similar to the obtained discharge-start voltage value to the charging roller. However, the discharge-start voltage value is roughly determined on the basis of the profile of the charging roller and the temperature and humidity sensor. Hence, the image forming apparatus of this example was configured to include a temperature and humidity sensor (environment sensor) that acquires the temperature and humidity of the atmosphere environment of the installed image forming apparatus, and to change the alternating-current voltage value to be applied to the charging roller with regard to an output of the sensor and a table held in a memory.

Also, when jobs of the black monochrome mode and the full-color mode are continuously executed, productivity is decreased if an attachment/detachment mechanism is operated in the middle of image formation, the image forming apparatus of this example executes image formation while the color unit being the image forming unit is held in contact with the intermediate transfer body. If monochrome image formation by a predetermined number of sheets is present, or in synchronization with a timing at which a certain kind of control is given during image formation, the control circuit executes a separation operation of the color unit and the intermediate transfer belt, so as to provide control to restrict a decrease in productivity.

Also, the image forming apparatus of this example executes an operation on a thick sheet or a special sheet, such as OHP or an embossed sheet, at a speed that is ½ or ⅓ of the image formation speed for a sheet of normal paper, to maintain transfer performance and fixing performance. However, it is technically difficult to ensure an equivalent level of banding and color misalignment between respective stations with many speed patterns for all combinations of a single or plural image forming units. Owing to this, during a low-speed operation, the image forming unit may possibly constantly contact the intermediate transfer body even in case of monochrome image formation.

As described above, when the photosensitive body of the image forming station not relating to image formation contacts the intermediate transfer belt, application of the charge bias and the development bias is stopped and the photosensitive body is rotationally driven. Consequently, the transfer remaining toner to be supplied to the cleaning blade is no longer present, and control may be given to execute the mode for supplying the toner to the cleaning blade to more actively restrict a cleaning failure.

The invention is not limited to the above-described examples and may be changed and modified without departing from the spirit and scope of the invention. Hence, to make clear the scope of the invention, the claims are attached as follows.

This application claims the benefit of Japanese Patent Application No. 2012-159517 filed Jul. 18, 2012, which is hereby incorporated by reference herein in its entirety.

REFERENCE SIGNS LIST

100 image forming apparatus
1 photosensitive drum (photosensitive body)
2 charging roller (charger)
101 charge power supply (applying means)
4 developing device (developing unit)
51 cleaning blade (cleaning means)
Pa to Pd image forming station (image forming unit)
11 intermediate transfer belt (intermediate transfer body)
613 controller, control unit (execution unit)
614 ammeter (detecting means)

The invention claimed is:

1. An image forming apparatus comprising:

a first image forming unit including a rotatable first photosensitive body, a first charger configured to charge the first photosensitive body with electricity, a first exposure unit configured to expose the charged first photosensitive body to light and form an electrostatic latent image on the first photosensitive body, and a first developing unit configured to develop the electrostatic latent image formed on the first photosensitive body by using a developer containing a toner and a carrier and form a toner image;

a second image forming unit including a rotatable second photosensitive body, a second charger configured to charge the second photosensitive body with electricity, a second exposure unit configured to expose the charged second photosensitive body to light and form an electrostatic latent image on the second photosensitive body, and a second developing unit configured to develop the electrostatic latent image formed on the second photosensitive body with a toner and form a toner image;

a movable intermediate transfer body on which the toner images formed on the first and second photosensitive bodies are transferred at a first transfer portion located downstream of the first developing unit and upstream of the first charger in a rotation direction of the first photosensitive body and at a second transfer portion located downstream of the second developing unit and upstream of the second charger in a rotation direction of the second photosensitive body;

a third transfer portion configured to transfer the toner images transferred on the intermediate transfer body, on a recording material;

a cleaning blade configured to contact the first photosensitive body at a position located downstream of the first transfer portion and upstream of the first charger in the rotation direction of the first photosensitive body and remove the toner adhering to the first photosensitive body; and an execution unit that executes a mode for execution of image formation with transfer on a recording medium by using the second image forming unit without using the first image forming unit in a state in which the first and second photosensitive bodies are in contact with the intermediate transfer body, wherein the first transfer portion is located upstream of the second transfer portion in a moving direction of the intermediate transfer body and downstream of the third transfer portion, and the execution unit includes a control unit configured to execute, during the execution of the mode, toner supply control that causes the toner to adhere to a region on the photosensitive body which does not contact a region on the intermediate transfer body on which the toner image formed by the second image forming unit is to be transferred, and supplies the toner to the cleaning blade by applying a development bias to the first developing unit without applying a direct-current voltage to the first charger, and that applies an alternating-current voltage to the first charger when at least the region on the first photosensitive body from which the toner is removed by the cleaning blade passes through the first charger.

2. The image forming apparatus according to claim 1, wherein, during the execution of the toner supply control, the control unit causes the toner to adhere to the region on the photosensitive body which does not contact the region on the intermediate transfer body on which the formed toner image is to be transferred by applying an alternating-current voltage whose peak-to-peak voltage is at least twice a discharge-start voltage to the first charger without applying the direct-current voltage to the first charger and applying the development bias to the first developing unit, and supplies the toner to the cleaning blade.

3. The image forming apparatus according to claim 1, further comprising:

a mechanism that causes the intermediate transfer body and at least the first photosensitive body to be brought into contact with and be separated from each other, wherein, during the execution of the mode, the execution unit causes the first and second photosensitive bodies to be brought into contact with the intermediate transfer body, and decreases speeds of the first and second photosensitive bodies and the intermediate transfer body.

4. The image forming apparatus according to claim 1, wherein the controller executes the toner supply control if a number of recording materials subjected to continuous image formation since the execution of the mode is started reaches a predetermined number.

5. The image forming apparatus according to claim 1, wherein the first charger contacts the first photosensitive body and charges the photosensitive body with electricity.

6. The image forming apparatus according to claim 1, wherein the execution unit can execute a mode for execution of image formation with transfer on a recording material by using the first and second image forming units.

* * * * *